United States Patent [19]

Geisler et al.

[11] Patent Number: 4,755,396

[45] Date of Patent: Jul. 5, 1988

[54] IMAGE RECEIVING ELEMENT FOR THERMAL PRINTERS

[76] Inventors: Thomas C. Geisler; Terrence A. Black, both at P.O. Box 33427, St. Paul, Minn. 55133-3427

[21] Appl. No.: 899,654

[22] Filed: Aug. 25, 1986

Related U.S. Application Data

[63] Continuation of Ser. No. 679,819, Dec. 10, 1984, abandoned.

[51] Int. Cl.[4] ..... B41M 5/26

[52] U.S. Cl. ..... 427/197; 346/135.1; 427/202; 427/256; 427/288; 427/375; 427/384; 427/385.5; 427/391; 427/395; 428/195; 428/206; 428/211; 428/331; 428/484; 428/488.1; 428/913; 428/914

[58] Field of Search ..... 346/208, 209, 135.1; 428/484, 488.1, 488.4, 913, 195, 206, 211, 331, 914; 427/197, 202, 256, 288, 375, 384, 385.5, 372.2, 391, 395; 503/208, 209

[56] References Cited

U.S. PATENT DOCUMENTS

| | | | |
|---|---|---|---|
| 3,360,367 | 12/1967 | Stricklin | 96/1 |
| 3,377,286 | 4/1968 | Stricklin | 252/62.1 |
| 3,493,412 | 2/1970 | Johnston et al. | 117/17.5 |
| 3,515,570 | 6/1970 | Suzuki | 117/25 |
| 3,619,279 | 11/1971 | Johnston et al. | 117/155 |
| 3,941,596 | 3/1976 | Heiart | 156/234 |
| 4,032,690 | 6/1977 | Kohmura et al. | 428/263 |
| 4,218,504 | 8/1980 | Yamato et al. | 428/207 |
| 4,247,595 | 1/1981 | Nomura et al. | 428/329 |
| 4,420,538 | 12/1983 | Nakamura et al. | 428/411 |

FOREIGN PATENT DOCUMENTS

| | | | |
|---|---|---|---|
| 0111838 | 9/1979 | Japan | 346/208 |

*Primary Examiner*—Bruce H. Hess

*Attorney, Agent, or Firm*—Trexler, Bushnell, Giangiorgi & Blackstone, Ltd.

[57] ABSTRACT

Image receiving medium comprising a substrate bearing on at least one major surface thereof a coating of heat-sensitive material comprising (a) material capable of existing in a supercooled state after melting and subsequent cooling, (b) at least one anti-fouling agent, and (c) optionally, a binder. The anti-fouling agent can be a wax, a silica, a metal silicate, or mixtures thereof.

22 Claims, No Drawings

IMAGE RECEIVING ELEMENT FOR THERMAL PRINTERS

This is a continuation of application Ser. No. 679,819, filed Dec. 10, 1984, now abandoned.

BACKGROUND OF THE INVENTION

This invention relates to imaging systems, and, more particularly, to receiving element useful in thermal imaging systems.

Processes wherein images can be formed by causing a heat-sensitive material to become tacky or fluid in image areas upon imagewise application of heat and then developed by adhering an imaging powder to the tacky image areas are known. An example of such a process is described in U.S. Pat. No. 3,941,596.

Thermal print heads can be used to tackify or fluidize the heat-sensitive material to form the latent image. A simple thermal print head comprises at least one resistance element between two conductors. The thermal print head may also comprise an array of resistance elements. Thus, for example, there may be a 5 by 7 element array on the print head. Additionally, the print head may be fixed or moveable with respect to the surface to be imaged.

The latent image pattern is formed by contacting the resistance element to the heat-sensitive material, providing electric current to the element for a time sufficient to heat the element and raise its temperature to a level sufficient to melt the material in the area of contact, discontinuing the electric current to the element, and relocating the element with respect to the material. The steps of contacting, heating and relocating are repeated until a sufficient number of melted dot-like areas have been provided to define the desired latent liquid image. When the print head has only a single element, the steps necessary to form the latent image must be repeated frequently before an image has been defined. When the print head comprises an array (or matrix) of elements, the steps necessary to form the latent image formation need be repeated fewer times.

A serious problem frequently encountered with thermal print head is fouling thereof with the heat-sensitive material of the image receiving surface. Generally, the print head is placed in direct contact with the heat-sensitive material. If even a small amount of material from the heat-sensitive coating transfers to the print head and forms a deposit thereon, resolution or image density, or both, is drastically reduced. In many cases, the thermal print heads are not readily accessible for easy cleaning. Some manufacturers of thermal printers recommend passing coarse bond paper through the printer to abrade the deposits from the print head. It is desirable to increase the interval between recommended cleanings of thermal print heads in order to save time and improve resolution.

SUMMARY OF THE INVENTION

The image receiving medium of the present invention comprises a substrate, e.g., a sheet, bearing on at least one major surface thereof a coating of heat-sensitive material comprising (a) material capable of existing in a supercooled state after melting and subsequent cooling, (b) at least one anti-fouling agent selected from the group consisting of waxes, silicas, metal silicates, and mixtures thereof, and (c) optionally, a binder.

Upon being imagewise heated with a thermal print head, a sheet bearing the aforementioned heat-sensitive coating material becomes tacky in the image areas. Particles of imaging powder can be adhered to these tackified areas. Optionally, the resulting images can be simultaneously or subsequently fixed.

The advantage of the heat-sensitive coating described is that the therml print head will avoid being fouled with residue from the coating material, thus assuring fomation of images having high resolution for extended periods of use, without the necessity for frequent cleaning of the print head.

DETAILED DESCRIPTION

The material capable of existing in a supercooled state after melting and subsequent cooling, hereinafter referred to as supercooling material, must have a melting temperature about 10° C. above ambient temperature. Ambient temperature, as used herein, refers to the temperature of the environment wherein the imaging process is conducted (e.g., room temperature of about 19° C. to 20° C.). The material of the coating must also form a supercooled melt when cooled to a temperature below its melting temperature, i.e. these materials exist, at least temporarily, as fluid metastable liquids after being melted and then cooled below their melting temperatures. When the latent image has been formed, it should wet the surface of the substrate. Moreover, the image must remain fluid and in place until it is contacted with (i.e., developed by) the dry imaging powder. Alternatively, it may be allowed to cool below its melting point to form a supercooled melt before the image areas are developed. Because the supercooled liquid has not regained its solid state, the material retains sufficient memory in the imaged areas to be developed and fixed. Once the material regains its solid state in the imaged areas, the latent image ceases to exist as a distinct area.

Preferably, the supercooling material melts within the approximate range of 40° C. to 140° C. Due to the lack in the available chemical literature of adequate data for defining the supercooling materials useful in the practice of the invention, definitive test procedures have been established, one which will now be described.

The melting point or melting range of the supercooling material is determined, for the purposes of this invention, by placing a small amount of the material in powder form on a glass microscope slide, covering the sample with a cover glass, heating the material on a microscope having a hot stage which is provided with temperature measuring means, and observing the temperature at which the particles melt and fuse.

A test for determining if a material is a supercooling material suitable for this invention is conveniently accomplished using the same sample as for the melting point test. A Leitz hot stage microscope having an electrically heated stage which may be cooled by circulation of cold water is used for both determinations. After the stage has been heated above the melting point of the sample, it is cooled and the temperature noted at which crystallization or solidification occurs. Both heating and cooling may be accomplished at somehwat higher rates of temperature change than are ordinarily specified where more precise measurements are required. Materials which when thus treated remain liquid to a temperature well below their melting points, e.g., at least about 60° C. below their melting points, have been found to be effective as supercooling materials for this invention; materials which crystallize or solidify at or near their melting points should not be used for making powder-retaining latent images in accordance with this invention. Some materials solidify to a flassy rather than a visibly crystalline state, a condition which is easily determined by applying moderate pressure on the cover glass with a spatula; glassy droplets retain their shape, whereas the liquid droplets flow or rapidly crystallize. A more elaborate test for determination of supercooling materials suitable for this invention is described in U.S. Pat. No. 3,360,367, incorporated herein by reference.

A number of supercooling materials are useful in the coatings of the invention. Representative examples of these materials include dicyclohexyl phthalate, diphenyl phthalate, triphenyl phosphate, dimethyl fumurate, benzotriazole, 2,4-dihydroxy benzophenone, tribenzylamine, benzil, vanillin, and phthalophenone. Another useful material of this type is "Santicizer 9", a mixture of ortho- and para-toluene sulfonamides commercially available from the Monsanto Chemical Company. Mixtures of these materials are also useful. The supercooling material can also consist of two or more materials that are not supercooling by themselves, but are recombinable to form a supercooling material.

The anti-fouling agent can be selected from the following classes of materials:

A. Waxes
B. Silicas
C. Metal silicates
D. Mixtures of waxes with silicas or metal silicates or both.

As used herein, the term "anti-fouling agent" means a material, i.e., a chemical compound or mixture of chemical compunds, that is added to the heat-sensitive composition that inhibits or prevents foreign substances from being deposited on the thermal print head. The waxes, silicas, and metal silicates that are useful as anti-fouling agents in the composition of this invention have at times been referred to as lubricants and antiblocking agents.

Waxes that are suitable for the composition of the present invention include aliphatic alcohols having at least 10 carbon atoms, fatty acids having at least 12 carbon atoms, fatty amides having at least 12 carbon atoms, fatty acid esters having at least 12 carbon atoms, symmetrical ketones derived from fatty acids having at least 12 carbon atoms, metal salts of fatty acids having at least 12 carbon atoms, and fluorocarbon polymers.

Aliphatic alcohols that are suitable for the compositions of this invention can be represented by the formula $$R^1—CH_2OH$$

wherein $R^1$ represents a saturated or unsaturated hydrocarbon radical, e.g. alkyl, alkenyl, having 9 to 21 carbon atoms. Representative examples of such suitable aliphatic alcohols include cetyl, stearyl, lauryl, myristyl, and mixtures thereof.

Fatty acids that are suitable for the compositions of this invention can be represented by the formula

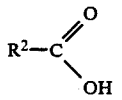

wherein $R^2$ represents a saturated or unsaturated hydrocarbon radical, e.g. alkyl, alkenyl, having 11 to 21 carbon atoms. Representative examples of such fatty acids include palmitic, stearic, lauric, myristic, and mixtures thereof.

Fatty amides that are suitable for the compositions of this invention can be represented by the formula

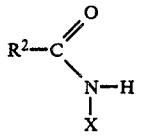

wherein $R^2$ is as defined above, and

X represents

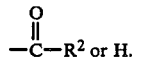

Representative examples of such fatty amides include stearamide, lauramide, oleamide, ethylene-bis-stearamide and mixtures thereof.

Fatty acid esters that are suitable for the compositions of this invention can be represented by the formula

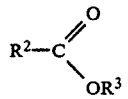

wherein $R^2$ is as defined above, and $R^3$ represents a saturated or unsaturated hydrocarbon radical, e.g., alkyl, alkenyl, having 1 to 22 carbon atoms, said hydrocarbon radical being unsubstituted or substituted with hydroxy group.

Representative examples of such suitable fatty acid esters include glyceryl stearates, e.g. glyceryl monostearate and diethylene glycol monostearate, glycol stearates, cetyl palmitate, stearyl stearate, n-butyl stearate, n-octyl stearate.

Symmetrical ketones that are suitable for the composition of this invention can be represented by the formula

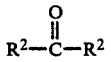

wherein $R^2$ is as defined above. Representative examples of symmetrical ketones derived from fatty acids that are useful in compositions of this invention include stearone and laurone.

Metal salts of fatty acids that are suitable for the compositions of this invention can be represented by the formula

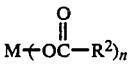

wherein

M represents a metal atom, n represents an integer from 1 to 3, inclusive, and $R^2$ is as defined above.

Metal salts of fatty acids that are suitable for the composition of the present invention include octoates, laurates, palmitates, and stearates of aluminum, lead, cadmium, barium, calcium, lithium, magnesium, and zinc. The metal stearates are most preferred. Blends of metal salts of fatty acids, e.g. zinc stearate, and fatty acids, e.g. stearic acid, are also useful as anti-fouling agents in the composition of the present invention.

One or more of the hydrogen atoms of the hydrocarbon radicals $R^1$, $R^2$, $R^3$ can be replaced with other atoms, e.g., halide, or groups of atoms, e.g. hydroxyl, so long as said atoms or groups of atoms do not adversely affect the anti-fouling characteristics of the wax anti-fouling agent.

Fluorocarbon polymers that are suitable for the composition of the present invention include polymeric tetrafluoroethylene.

Silicas and metal silicates can be used as the anti-fouling agent in the composition of the present invention. Representative examples of these anti-fouling agents include silica gel, fumed silica, precipitated silica, clay, kaolin, and talc.

Silicas and metal silicates can be blended with waxes such as metal salts of fatty acids, e.g. metal stearates, fluorocarbon polymers, e.g., polytetrafluoroethylene, fatty amides, e.g., stearamide, and the like, to improve their anti-fouling action.

Binders can also be included in the heat-sensitive composition of the image receiving element. The heat-sensitive composition would tend to flake off under certain conditions in the absence of binders. Representative examples of organic polymeric binders suitable for this invention include water soluble binders such as polyvinyl alcohol, polyvinyl pyrrolidone, hydroxyethyl cellulose, and organic solvent soluble binders such as cellulose acetate, ethyl cellulose, and polyvinyl chloride.

Substrates suitable for use in the invention can be selected from any dry, solid material that is compatible with the coating of normally solid, non-tacky material. Examples of materials suitable for the substrate include polymeric films, metal foils, and paper. The preferred substrate is paper.

The range of concentration of each ingredient in the heat-sensitive coating material has been found to be important. If too little anti-fouling agent is employed, the thermal print heads will become fouled relatively rapidly. If too much anti-fouling agent is employed, the optical density of the toned image will be too low. The ranges of concentration of each ingredient is also dependent upon the nature of anti-fouling agent employed. When waxes are used as the anti-fouling agent, the concentration ranges for essential ingredients of the heatsensitive coating material are as follows:

| Ingredient | Percent by weight |
|---|---|
| Supercooling material | 55 to 99 |
| Anti-fouling agent | 1 to 16 |
| Binder | 0 to 40 |

When silicas or metal silicates are used as the anti-fouling agent, the concentration ranges for essential ingredients of the heat-sensitive material are as follows:

| Ingredient | Percent by weight |
|---|---|
| Supercooling material | 50 to 95 |
| Anti-fouling agent | 5 to 40 |
| Binder | 3 to 40 |

When silicas or metal silicates or both are used in combination with waxes as the anti-fouling agent, the concentration ranges for essential ingredients of the heat-sensitive material are the same as when silicas alone or metal silicates alone are used as the anti-fouling agent.

The coating material can be applied to the surface of a substrate by a variety of techniques, including both solvent coating and dry coating. For example, the heat-sensitive coating material can be dissolved or dispersed in an appropriate solvent (e.g., acetone, or water), the solution or dispersion applied to the substrate, and the solvent allowed to evaporate. The previously dissolved or dispersed solid material is then allowed to crystallize. Evaporation of the solvent can be accelerated, if desired, by heating the coated substrate. However, care should be taken to insure that the substrate does not curl or otherwise suffer adverse effects as a result of the heating. Additionally, crystallization of the dissolved or dispersed solid material can be accelerated by seeding the coated substrate with like solid material.

Dry coating techniques can also be utilized. The solid form of the heat-sensitive coating material can be brushed or rubbed onto the substrate. Preferably, the solid form of material is either in the form of a powder or in a form in which it can readily be converted to a powder. The dry coating technique is an efficient means for applying the material to the substrate. Materials applied by the dry coating technique do not soak into the substrate as they do with solvent coating techniques. This is beneficial since it reduces the amount of coating material applied to the substrate while continuing to provide as good an image as that when the coating material is applied by a solvent coating technique. Furthermore, when a plain paper substrate is coated by the dry coating technique, the resultant sheet appears indistinguishable from an uncoated paper sheet and can be used immediately after coating.

The exact amount of the coating material on the substrate can vary. There should be sufficient coating material to form a latent image but not so much material that the thermal printing means is adversely affected, the article becomes too dielectric, or gives a greasy feel or appearance. A sufficient amount of coating material must be used so that once the latent image has been formed, there will be sufficient adhesion between it and the imaging powder to overcome the triboelectric or magnetic forces, or both, holding the imaging powder to the development roll.

It has been found that from about 0.1 to 5 $g/m^2$ provides excellent results. When solvent coating is utilized, the substrate preferably bears from 0.1 to 2 $g/m^2$ of the material, more preferably from about 0.1 to 1.2 $g/m^2$, and most preferably from about 0.2 to 1.0 $g/m^2$ of the material. These relatively small amounts of coating material are sufficient to provide latent images that can be developed and essentially permanently fixed to the substrate.

When dry coating techniques are employed, the particulate material is substantially absorbed onto the substrate surface. When the substrate is paper, the material becomes attached to the surface of the paper fibers.

The imaged area must provide sufficient adhesion to the dry imaging powder. The imaged area may react with the imaging powder; it may form a solution with the powder; it may wet the powder; or it may either absorb or be adsorbed by the powder. Whatever the interaction between the powder and the imaged area is, the imaged area must hold the powder until the powder is fixed to the substrate.

Coatings were evaluated by printing a solid bar (26 inches long) with the thermal print head in the EMT 9140 Facsimile Machine (3M Company). The latent image was then developed with the toner station of a VQC compact copier (3M Company) and toner powder described in U.S. Pat. No. 3,925,219, Example 1. The toner particles ranged in size from 10 to 45 micrometers.

The printer utilized a 100 styli/inch thick film print head manufactured by Rolm Corporation.

Print head residue was evaluated by visually inspecting the head under 5× magnification and rated according to the following criteria:

None—No visible residue

Trace—Small specks of coating adhering to print head

Light—Small amount of residue forming continuous coating on portion of print head, but not interfacing with head contact to paper Medium—Residue forms continuous coating over approximately half of the print head Heavy—Large amount of residue on and behind print head and interfering with head contact to paper and heat transfer.

Image density after development was measured with a MacBeth TR 924 densitometer in reflection mode.

EXAMPLES 1-8

Coating material formulations are set forth in Table I. In the following table the amounts are in parts by weight.

TABLE I

| Ingredient | Amount Example 1 | 2 | 3 | 4 | 5 | 6 | 7 | 8 |
|---|---|---|---|---|---|---|---|---|
| Supercooling material: | | | | | | | | |
| Diphenyl phthalate | 90 | — | — | 85 | 75 | — | — | — |
| Dicylcohexyl phthalate | — | 90 | 90 | — | — | 54 | 80 | 65 |
| Binder: | | | | | | | | |
| Ethyl cellulose | 10 | — | 10 | 10 | 10 | — | 10 | 10 |
| Cellulose acetate | — | 10 | — | — | — | 10 | — | — |
| Coating Solvent: | | | | | | | | |
| Acetone | 300 | 300 | 300 | 300 | 300 | 300 | 300 | 300 |
| Anti-fouling agent: | | | | | | | | |
| Calcium stearate | — | — | — | 5 | 5 | — | — | — |
| Aluminum silicate[1] | — | — | — | — | 10 | 30 | — | — |
| Polytetrafluoroethylene[2] | — | — | — | — | — | 6 | 10 | — |
| Silica gel[3] | — | — | — | — | — | — | — | 25 |

[1]ASP ® 101 kaolin from Engelhard Minerals and Chemicals Corp.
[2]Fluo HT2 from Micro Powders, Inc.
[3]Syloid ® X-6000 from W. R. Grace and Co.

The phthalates and cellulosic binders were dissolved in acetone. The wax anti-fouling agents were dispersed into the phthalate/binder/acetone solution using an ultrasonic bath. The filler anti-fouling agents were dispersed into the phthalate/binder/acetone solution using a homogenizer. The dispersions were coated on paper with a ½ inch diameter #8 wire wound rod and air dried, yielding a dry coat weight of 0.28 to 0.36 g/ft$^2$.

Each coated sheet was evaluated and the results are shown in Table II.

TABLE II

| | Printhead residue | Optical density |
|---|---|---|
| 1 | Light | 1.55 |
| 2 | Light | 1.10 |
| 3 | Heavy | 1.50 |
| 4 | Trace | 1.58 |
| 5 | Trace | 1.60 |
| 6 | None | 1.60 |
| 7 | None | 1.65 |
| 8 | None | 1.20 |

When no anti-fouling agent was present in the heat-sentitive material, print head residue ranged from light to heavy. When at least one anti-fouling agent was included in the heat-sensitive material, print head residue ranged form none to trace.

EXAMPLE 9

This example demonstrates the effect of coating weight on printhead residue.

The following formulation was used to prepare test samples:

| Ingredient | Parts by weight |
|---|---|
| Dicyclohexylphthalate | 80 |
| Ethyl cellulose[1] | 10 |
| Polytetrafluoroethylene[2] | 10 |
| Acetone | 300 |

[1]N-200 grade from Hercules Inc.
[2]Fluo HT2 from Micro Powders Inc.

Samples of the formulation were coated on paper at coating weights ranging from 0.26 g/m$^2$ to 0.95 g/m$^2$. Coating weight was varied by using different Mayer rods. The results of the printhead residue evaluation are shown in Table III.

TABLE III

| Mayer rod | Dry coating weight (g/m$^2$) | Printhead residue | Optical density |
|---|---|---|---|
| 4 | 0.26 | none | 1.40 |
| 8 | 0.35 | none | 1.35 |
| 14 | 0.62 | none | 1.58 |
| 18 | 0.74 | trace | 1.54 |
| 22 | 0.95 | light | 1.45 |

From Table III, it can be seen that a dry coating weight of 0.62 g/m$^2$ provided optimum optical density value with no print head residue.

EXAMPLES 10–16

These examples demonstrate the effect of different waxes in combination with metal silicate (aluminum silicate) in the coating composition.

The following formulations were used for the examples. In the following table, the amounts are in parts by weight.

TABLE IV

| Ingredient | Amount Example 10 | 11 | 12 | 13 | 14 | 15 | 16 |
|---|---|---|---|---|---|---|---|
| Supercooling material: | | | | | | | |
| Dicyclohexyl phthalate | 60 | 56 | 56 | 56 | 56 | 56 | 56 |
| Binder: | | | | | | | |
| Cellulose acetate | 20 | 20 | 20 | 20 | 20 | 20 | 20 |
| Anti-fouling agent: | | | | | | | |
| Aluminum silicate[1] | 20 | 17 | 17 | 17 | 17 | 17 | 17 |
| Stearic acid | — | 7 | — | — | — | — | — |
| Stearamide | — | — | 7 | — | — | — | — |
| Polytetra-fluoroethylene[2] | — | — | — | 7 | — | — | — |
| Polytetra-fluoroethylene/polyethylene[3] | — | — | — | — | 7 | — | — |
| Calcium stearate | — | — | — | — | — | 7 | — |
| Ethylene-bis-stearamide | — | — | — | — | — | — | 7 |
| Coating solvent: | | | | | | | |
| Acetone | 300 | 300 | 300 | 300 | 300 | 300 | 300 |

[1]ASP ® 101 kaolin from Engelhard Minerals and Chemicals Corp.
[2]Fluo HT2 from Micro Powders Inc.
[3]Polyfluo 540 from Micro Powders Inc.

Each coating was evaluated and the results are shown in Table V.

TABLE V

| Example | Printhead residue | Optical density |
|---|---|---|
| 10 | medium | 0.40 |
| 11 | light | 0.22 |
| 12 | trace | 0.15 |
| 13 | trace | 0.75 |
| 14 | trace | 0.65 |
| 15 | trace | 0.60 |
| 16 | light | 0.40 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Image receiving element comprising a substrate bearing on at least one major surface thereof an image receptive coating comprising a material capable of existing in a supercooled state after melting and subsequent cooling, said material having a melting temperature about 10° C. above ambient temperature and comprising 75 weight percent to 99 weight percent of the coating, wax anti-fouling agent comprising 1 weight percent to 16 weight percent of the coating, and binder comprising up to 40 weight percent of the coating.

2. The element of claim 1 wherein said anti-fouling agent is selected from the group consisting of aliphatic alcohols, fatty acids, fatty amides, fatty acid esters, and symmetrical ketones derived from fatty acids.

3. The element of claim 2 wherein said anti-fouling agent is represented by the formula $$R^1—CH_2OH$$

wherein $R^1$ represents a saturated or unsaturated hydrocarbon radical having 9 to 21 carbon atoms.

4. The element of claim 2 wherein said anti-fouling agent is represented by the formula

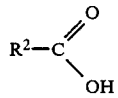

wherein $R^2$ represents a saturated or unsaturated hydrocarbon radical having 11 to 21 carbon atoms.

5. The element of claim 2 wherein said antifouling agent is represented by the formula

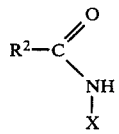

wherein $R^2$ represents a saturated or unsaturated hydrocarbon radical having 11 to 21 carbon atoms, and X represents $$—\overset{O}{\overset{\|}{C}}—R^2 \text{ or H.}$$

6. The element of claim 2 wherein said antifouling agent is represented by the formula

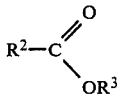

wherein $R^2$ represents a saturated or unsaturated hydrocarbon radical having 11 to 21 carbon atoms, $R^3$ represents a hydrocarbon radical having 1 to 21 carbon atoms.

7. The element of claim 2 wherein said anti-fouling agent is represented by the formula $$R^2—\overset{O}{\overset{\|}{C}}—R^2$$

wherein $R^2$ represents a saturated or unsaturated hydrocarbon radical having 11 to 21 carbon atoms.

8. The element of claim 1 wherein said anti-fouling agent is a metal salt of a fatty acid.

9. The element of claim 8 wherein said anti-fouling agent is represented by the formula $$M\left(OC\overset{O}{\overset{\|}{}}—R^2\right)_n$$

wherein $R^2$ represents a saturated or unsaturated hydrocarbon radical having 11 to 21 carbon atoms, n represents an integer from 1 to 3, inclusive, M represents a metal atom.

10. The element of claim 8 wherein said wax anti-fouling agent is represented by the formula $$M\left(OC(=O)-R^2\right)_n$$

wherein $R^2$ represents a saturated or unsaturated hydrocarbon radical having 11 to 21 carbon atoms, n represents an integer from 1 to 3, inclusive M represents a metal atom.

11. The element of claim 1 wherein said anti-fouling agent is fluorochemical wax.

12. A method of preparing an image comprising the steps of:

(1) providing the image receiving element of claim 1, (2) causing the image receptive coating to become tacky or fluid in image areas upon imagewise application of heat, said heat being provided by a thermal print head, and (3) developing the image by adhering an imaging powder to the tacky or fluid image areas.

13. Image receiving element comprising a substrate bearing on at least one major surface thereof an image receptive coating comprising a material capable of existing in a supercooled state after melting and subsequent cooling, said material having a melting temperature about 10° C. above ambient temperature and comprising 50 weight percent to 95 weight percent of the coating, mixture of anti-fouling agents comprising wax and at least one member of group selected from silica and metal silicate, said mixture comprising 5 weight percent to 40 weight percent of the coating, and binder comprising 3 weight percent to 40 weight percent of the coating, provided that said silica or silicate portion of said mixture of anti-fouling agents comprises 10 weight percent to 30 weight percent of said mixture and that said wax portion of said mixture of anti-fouling agents comprises up to 12.5 weight percent of said mixture.

14. The element of claim 13 wherein said wax anti-fouling agent is selected from the group consisting of aliphatic alcohols, fatty acids, fatty amides, fatty acid esters, and symmetrical ketones derived from fatty acids.

15. The element of claim 14 wherein said wax anti-fouling agent is represented by the formula $$R^1-CH_2OH$$

wherein $R^1$ represents a saturated or unsaturated hydrocarbon radical having 9 to 21 carbon atoms.

16. The element of claim 14 wherein said wax anti-fouling agent is represented by the formula

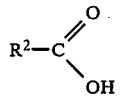

17. The element of claim 14 wherein said wax anti-fouling agent is represented by the formula

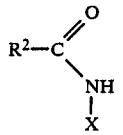

wherein $R^2$ represents a saturated or unsaturated hydrocarbon radical having 11 to 21 carbon atoms, and X represents $$-C(=O)-R^2 \text{ or H.}$$

18. The element of claim 14 wherein said wax anti-fouling agent is represented by the formula

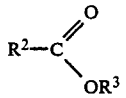

wherein $R^2$ represents a saturated or unsaturated hydrocarbon radical having 11 to 21 carbon atoms, $R^3$ represents a hydrocarbon radical having 1 to 21 carbon atoms.

19. The element of claim 14 wherein said wax anti-fouling agent is represented by the formula $$R^2-C(=O)-R^2$$

wherein $R^2$ represents a saturated or unsaturated hydrocarbon radical having 11 to 21 carbon atoms.

20. The element of claim 13 wherein said wax anti-fouling agent is a metal salt of a fatty acid.

21. The element of claim 13 wherein said wax anti-fouling agent is a fluorochemical wax.

22. A method of preparing an image comprising the steps of:

(1) providing the image receiving element of claim 13, (2) causing the image receptive coating to become tacky or fluid in image areas upon imagewise application of heat, said heat being provided by a thermal print head, and (3) developing the image by adhering an imaging powder to the tacky or fluid image areas.

* * * * *

UNITED STATES PATENT AND TRADEMARK OFFICE

CERTIFICATE OF CORRECTION

PATENT NO. : 4,755,396

DATED : July 5, 1988

INVENTOR(S) : Thomas C. Geisler et al

It is certified that error appears in the above-identified patent and that said Letters Patent is hereby corrected as shown below:

On the Title Page, add --[73] Assignee: Minnesota Mining and Manufacturing Company, St. Paul, Minn.--.

Attorney, Agent, or Firm should read --Donald M. Sell; David L. Weinstein--.

Col. 2, line 8, "therml" should read --thermal--.

Col. 3, line 4, "flassy" should read --glassy--.

Col. 3, line 24, "recombinable" should read --combinable--.

Signed and Sealed this

Eleventh Day of July, 1989

*Attest:*

DONALD J. QUIGG

*Attesting Officer*

*Commissioner of Patents and Trademarks*